US008857831B1

(12) United States Patent
Rotondo

(10) Patent No.: US 8,857,831 B1
(45) Date of Patent: Oct. 14, 2014

(54) SKATEBOARD TENSIONING SYSTEM

(71) Applicant: James W. Rotondo, Irvine, CA (US)

(72) Inventor: James W. Rotondo, Irvine, CA (US)

( * ) Notice: Subject to any disclaimer, the term of this patent is extended or adjusted under 35 U.S.C. 154(b) by 28 days.

(21) Appl. No.: 13/721,714

(22) Filed: Dec. 20, 2012

Related U.S. Application Data

(60) Provisional application No. 61/580,173, filed on Dec. 23, 2011.

(51) Int. Cl.
*B62M 1/00* (2010.01)
*A63C 17/00* (2006.01)
*A63C 17/01* (2006.01)

(52) U.S. Cl.
CPC ..... *A63C 17/012* (2013.01); *A63C 17/0046* (2013.01)
USPC ..... 280/87.042; 280/11.27

(58) Field of Classification Search
CPC ..... A63C 17/01; A63C 17/02; A63C 17/04; A63C 17/012; A63C 17/0046; A63C 17/0093
USPC ..... 280/11.27, 11.28, 87.042, 25, 79, 280/87.041, 87.03, 87.021
See application file for complete search history.

(56) References Cited

U.S. PATENT DOCUMENTS

| | | | | |
|---|---|---|---|---|
| 3,023,022 | A * | 2/1962 | Boyden | 280/87.042 |
| 3,926,449 | A * | 12/1975 | Wilje | 280/842 |
| 3,954,279 | A * | 5/1976 | Guerr | 280/87.042 |
| 4,123,080 | A * | 10/1978 | Agajanian | 280/220 |
| 5,154,436 | A * | 10/1992 | Jez et al. | 280/87.042 |
| 5,931,480 | A * | 8/1999 | Schroeder | 280/11.28 |
| 5,984,328 | A * | 11/1999 | Tipton | 280/87.042 |
| 6,206,390 | B1 * | 3/2001 | Borg | 280/87.042 |
| 8,083,241 | B2 * | 12/2011 | Corrente | 280/87.042 |
| 8,292,311 | B2 | 10/2012 | De Las Casas | |
| 2004/0140633 | A1 * | 7/2004 | Beedle et al. | 280/11.27 |
| 2005/0269794 | A1 * | 12/2005 | Lukes | 280/87.042 |
| 2007/0052190 | A1 * | 3/2007 | Forsberg | 280/87.042 |
| 2007/0170677 | A1 * | 7/2007 | Wake | 280/87.042 |
| 2012/0146304 | A1 * | 6/2012 | Fehn | 280/87.042 |
| 2013/0305790 | A1 * | 11/2013 | Seele et al. | 70/58 |

* cited by examiner

*Primary Examiner* — John Walters
*Assistant Examiner* — Brian Swenson
(74) *Attorney, Agent, or Firm* — Eric Karich

(57) ABSTRACT

A skateboard tensioning system has a pair of risers that are each shaped and sized to be positioned between a board body and trucks of the skateboard. Fastener holes through each of the risers are positioned to correspond with mounting holes of the trucks. Extended fasteners fit through the board body, the fastener holes in the riser, and the mounting holes of the base plate. The system also includes a cable that connects the pair of risers, and a tensioning mechanism for providing tension so that the risers are pulled towards one another, thereby adjusting the suspension of the skateboard.

3 Claims, 3 Drawing Sheets

SKATEBOARD TENSIONING SYSTEM

CROSS-REFERENCE TO RELATED APPLICATIONS

This application for a utility patent claims the benefit of U.S. Provisional Application No. 61/580,173, filed Dec. 23, 2011.

STATEMENT REGARDING FEDERALLY SPONSORED RESEARCH

Not Applicable

BACKGROUND OF THE INVENTION

1. Field of the Invention

This invention relates generally to skateboard accessories, and more particularly to a skateboard tensioning system for adjusting the stiffness of a skateboard.

2. Description of Related Art

A standard skateboard includes two metal (usually aluminum alloy) trucks, which connect to the wheels and deck. The trucks are further composed of two parts: a baseplate of the truck is screwed to the deck, and a hanger receives an axle therethrough. Between the baseplate and the hanger are bushings that provide a cushion mechanism for turning the skateboard.

The stiffness of the skateboard (i.e., the "suspension") is dictated by the thickness of the board, and the material used. This can be of particular interest in long skateboards, especially when the board is being ridden by a much larger and heavier rider, who may require a tighter suspension for optimal riding conditions. In any case, it is desirable to be able to adjust the suspension of the board.

The prior art teaches skateboards that receive their suspension and handling characteristics from the board used. However, the prior art does not teach an accessory that may be used to adjust the suspension of a skateboard. The present invention fulfills these needs and provides further advantages as described in the following summary.

SUMMARY OF THE INVENTION

The present invention teaches certain benefits in construction and use which give rise to the objectives described below.

The present invention provides a skateboard tensioning system for adjusting a suspension of a skateboard. The skateboard tensioning system comprises a pair of risers that are each shaped and sized to be positioned between a board body and trucks of the skateboard. Fastener holes through each of the risers are positioned to correspond with mounting holes of the trucks. Extended fasteners fit through the board body, the fastener holes in the riser, and the mounting holes of the base plate. A cable that connects the pair of risers, and a tensioning mechanism tensions the cable so that the risers are pulled towards one another, thereby adjusting the suspension of the skateboard.

A primary objective of the present invention is to provide a skateboard tensioning system having advantages not taught by the prior art.

Another objective is to provide a skateboard tensioning system capable of adjusting the suspension of a skateboard.

A further objective is to provide a skateboard tensioning system that enables a skateboard to be adjusted to accommodate larger and heavier riders using a standard skateboard.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

The above-described drawing figures illustrate the invention, a skateboard tensioning system 10 adapted to apply a desired level of tension to a skateboard 12 to adjust its rigidity and performance.

Figure 1:
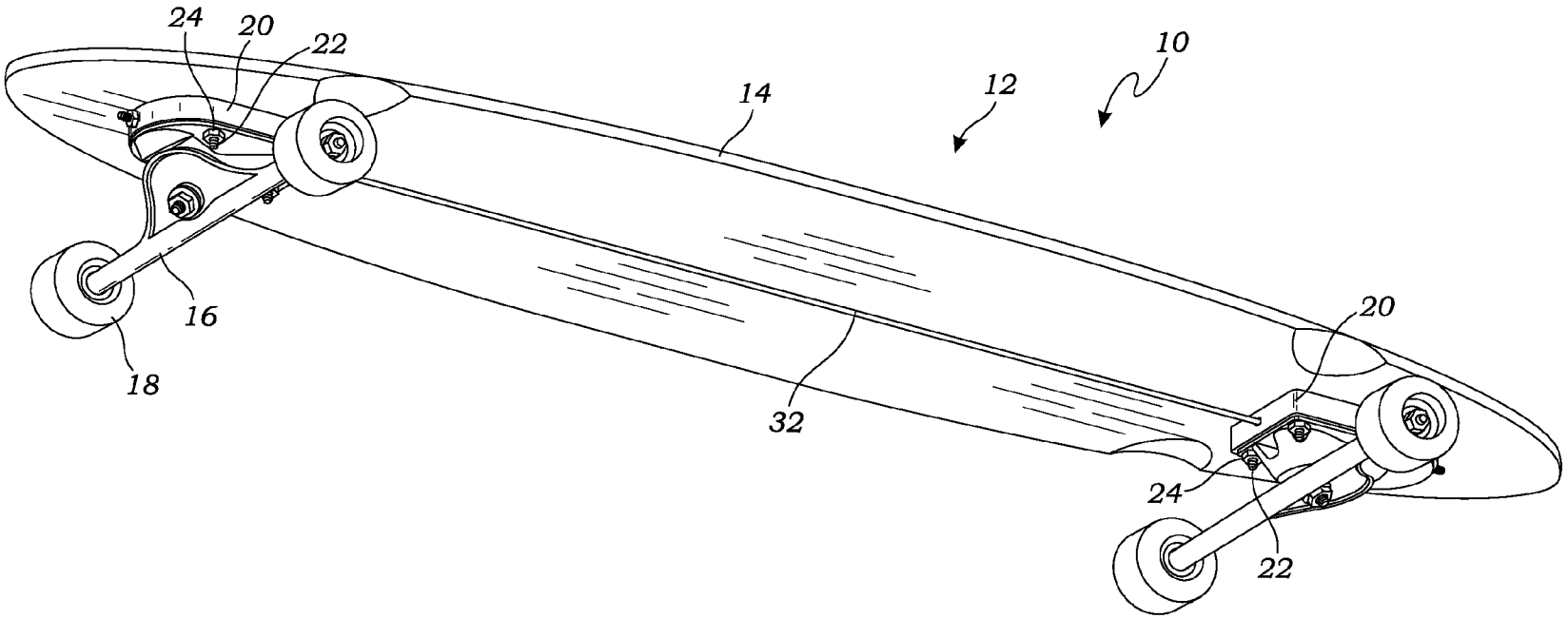
FIG. 1 is a perspective view of a skateboard having a skateboard tensioning system according to one embodiment of the present invention.
Figure 2:
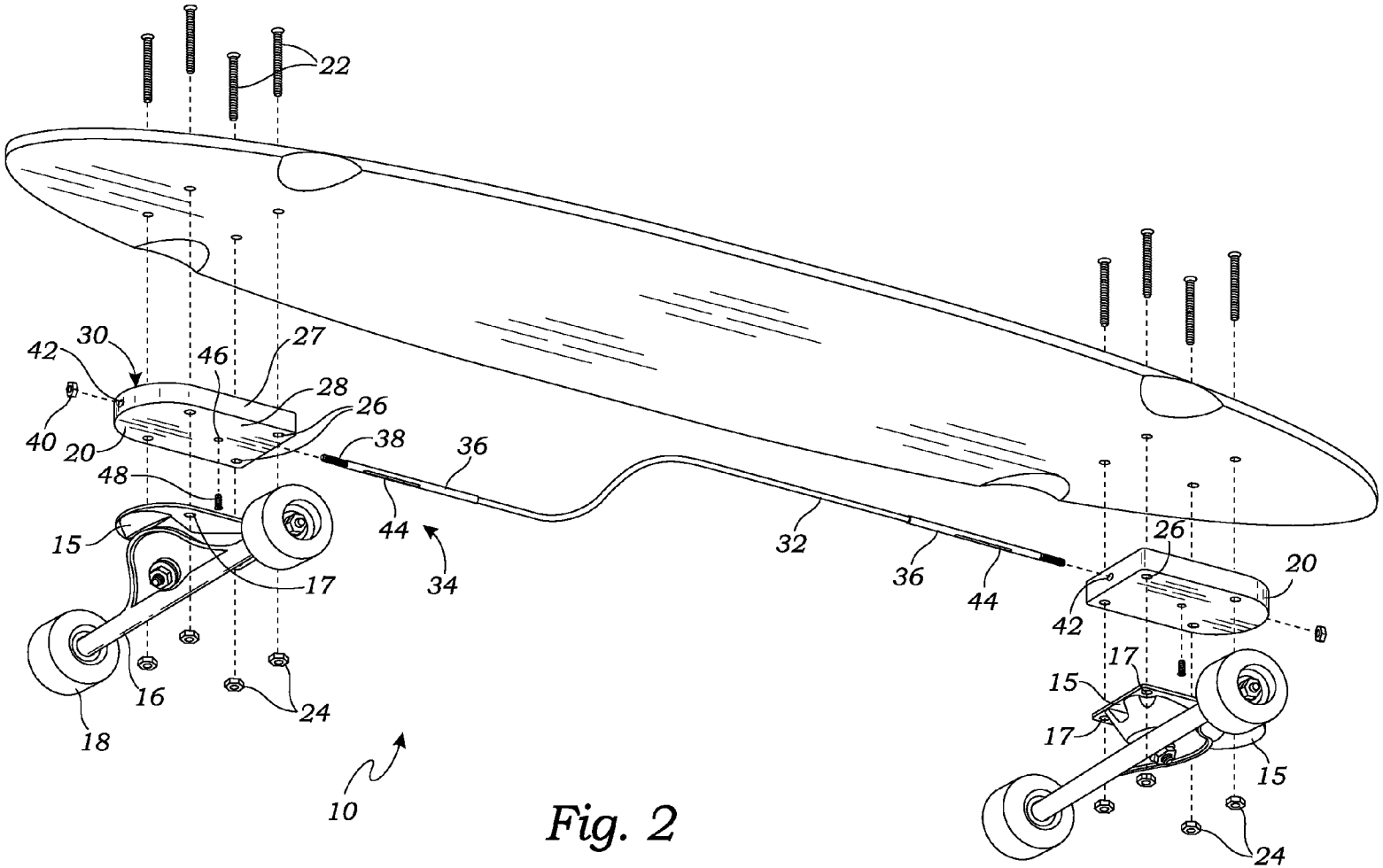
FIG. 2 is an exploded perspective view thereof.

FIG. 1 is a perspective view of one embodiment of the skateboard 12 having the skateboard tensioning system 10. FIG. 2 is an exploded perspective view thereof. As illustrated in FIGS. 1-2, the skateboard 12 is of standard construction, having a board body 14 and a pair of trucks 16. Each of the trucks 16 has a baseplate 15 with mounting holes 17 for operably mounting the trucks 16 on the board body 14. The trucks 16 provide wheels 18 for the movement of the skateboard 12. These components are of standard construction, and the skateboard tensioning system 10 can be adapted to work with skateboards 12 already known in the art.

The skateboard tensioning system 10 includes a pair of risers 20 that are each adapted to be positioned beneath one of the pair of trucks 16. Extended fasteners 22 (e.g., long bolts, or other forms of fasteners 22 known in the art), which may include nuts 24, are used to fasten the pair of trucks 16 to the board body 14, with the risers 20 being positioned between the truck 16 and the board body 14, with the extended fasteners 22 fitting through fastener holes 26 in the riser 20.

Each of the risers 20 have a perimeter 27 that is shaped to generally conform to its respective baseplate 15 of one of the trucks 16, and each includes a top surface 28 adapted to abut the board body 14, and a bottom surface 30 adapted to abut the truck 16. The risers 20 may be constructed of any suitable strong and durable material, such as metal or hard plastic, to withstand the forces imparted by the skateboard tensioning system 10.

As illustrated in FIG. 2, the skateboard tensioning system 10 also includes a cable 32 adapted to connect the pair of risers 20, and tensioning mechanism 34 for tensioning the cable 32 so that the risers 20 are pulled towards one another. In one embodiment, the tensioning mechanism 34 includes rods 36 at each end of the cable 32, the rods 36 each having an externally threaded end 38 for receiving a fastening nut 40. In this embodiment, each of the risers 20 includes a longitudinal conduit 42 shaped to receive the rod 36 therethrough. By tightening the fastening nuts 40 at each end of the cable 32, the cable 32 can be tightened to tension the risers 20.

As illustrated in FIG. 2, in the present embodiment the rods 36 may each include a longitudinal slot 44, and the risers each include an internally threaded screw hole 46 that communicates with the longitudinal conduit 42 so that a screw 48 can be screwed into the riser 20 to extend into the longitudinal conduit 42, and thereby also into the longitudinal slot, to prevent rotation of the rod 36. The screw 48, once in place, enables the fastening nuts 40 to be tightened, while preventing the rod 36 from rotating and preventing tightening of the tensioning mechanism 34. In an alternative embodiment, not illustrated, other means may be used to prevent rotation of the rod 36, such as using a rod with a non-round (e.g., square) cross-section.

While two rods 36 are currently illustrated, and two fastening nuts 40, only one is required to enable adjustment, and other end may be otherwise secured to the riser 20. Also, the fastening nuts 40 may be shaped to enable hand adjustment of the nuts 40, so that a tool is not required to adjust the suspension of the skateboard 12.

While one embodiment of the tensioning mechanism 34 is illustrated, alternative tensioning mechanisms 34 may also be used. For example, instead of bolts and nuts, varying forms of levers and cams (not illustrated) may be used, using techniques generally known in the art, to pull the cable 32 tight for tensioning the board body 14. Furthermore, many forms of screws mechanisms (not illustrated) may be used to pull the cable 32 tight, or other mechanical structures known in the art for applying such tension.

Figure 3:
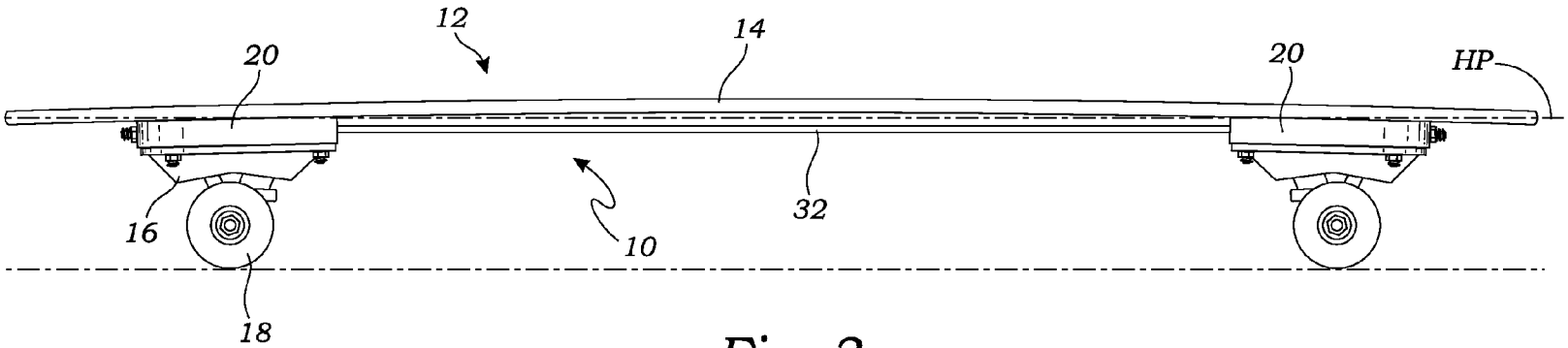
FIG. 3 is a side elevational view thereof, illustrating a board of the skateboard in a convex configuration under the tension of the skateboard tensioning system.

FIG. 3 is a side elevational view of the skateboard 12, illustrating the board body 14 of the skateboard 12 in a convex configuration under the tension of the skateboard tensioning system 10. As illustrated in FIG. 3, once the tensioning mechanism 34 is tightened, the cable 32 imparts a tension on the board body 14 of the skateboard 12, imparting a slightly convex curve to the board body 14 with respect to a horizontal plane HP. The convex curve of the board body 14 provides superior rigidity to the board body 14, and improved performance of the skateboard 12, especially when the skateboard 12 is ridden by a larger user.

Figure 4:
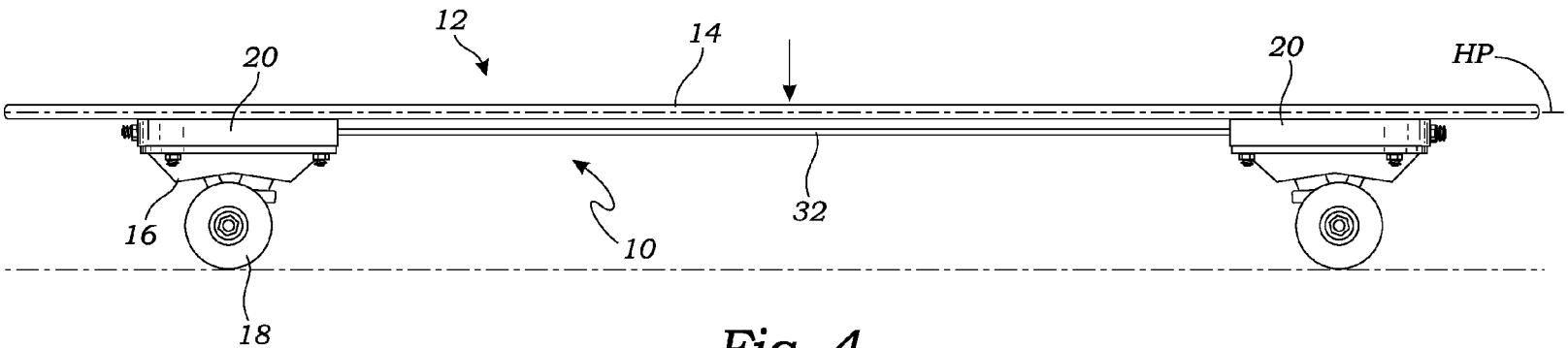
FIG. 4 is a side elevational view thereof, illustrating the board of the skateboard once a downward force has been applied to the board, such as during use.

FIG. 4 is a side elevational view of the skateboard 12, illustrating the board body 14 of the skateboard 12 once a downward force has been applied to the board body 14, such as during use. As illustrated in FIG. 4, the downward force tends to push the board body 14 towards a configuration in which the board body 14 is positioned on the horizontal plane HP, although this can vary depending upon the strength of the force, the rigidity of the board body 14, and the strength of the tensioning mechanism 34.

As used in this application, the words "a," "an," and "one" are defined to include one or more of the referenced item unless specifically stated otherwise. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application.

What is claimed is:

1. A skateboard tensioning system for adjusting a suspension of a skateboard having a board body, a pair of trucks each having a base plate with mounting holes, and wheels operably mounted on the trucks, the skateboard tensioning system comprising:

a pair of risers that are each shaped and sized to be positioned beneath one of the pair of trucks, between the truck and the board body, each of the risers having a perimeter shaped to generally conform to its respective base plate of one of the trucks, wherein the risers each include a longitudinal conduit;

fastener holes through each of the risers positioned to correspond with the mounting holes of the trucks;

extended fasteners that are long enough to fasten each of the trucks to the board body with the risers being positioned therebetween, such that the fasteners fit through the board body, the fastener holes in the riser, and the mounting holes of the base plate;

a cable; and a pair of rods, each connected to one end of the cable, wherein the rods each extend into the longitudinal conduit of one of the risers and are engaged with the risers so that the cable pulls the risers towards one another, thereby adjusting the suspension of the skateboard.

2. A skateboard comprising:

a board body;

a pair of trucks each having a base plate with mounting holes, and wheels operably mounted on the trucks; and a skateboard tensioning system comprising:

a pair of risers that are each positioned between one of the trucks and the board body, wherein the risers each include a longitudinal conduit;

fastener holes through each of the risers positioned to correspond with the mounting holes of the trucks;

extended fasteners that extend through the board body, one of the risers, and one of the trucks, to fasten each of the trucks to the board body with the risers being positioned therebetween; and a cable that includes a rod connected to each end of the cable, wherein each of the rods engages the longitudinal conduit of one of the risers so that the cable pulls the risers towards one another, thereby adjusting the suspension of the skateboard.

3. A skateboard comprising:

a board body;

a pair of trucks each having a base plate with mounting holes, and wheels operably mounted on the trucks;

a pair of risers that are each positioned between one of the trucks and the board body, each of the pair of risers having a longitudinal conduit therethrough, and a screw hole perpendicular to the board body and communicating with the longitudinal conduit;

fastener holes through each of the risers positioned to correspond with the mounting holes of the trucks;

extended fasteners that extend through the board body, one of the risers, and one of the trucks, to fasten each of the trucks to the board body with the risers being positioned therebetween;

a cable;

a pair of rods, each connected to one end of the cable, at least one of the rods having an externally threaded end, wherein each of the rods extends through one of the longitudinal conduits of the risers;

a longitudinal slot through at least one of the rods;

a screw that engages the screw hole of one of the risers and extends through the longitudinal slot for preventing rotation of the rod; and at least one fastening nut that engages the at least one externally threaded end of the rod to vary the length of the cable when the fastening nut is loosened or tightened.

* * * * *